United States Patent [19]

Whipps

[11] Patent Number: 4,848,962

[45] Date of Patent: Jul. 18, 1989

[54] SLIDE GATE AND SEALS THEREFOR

[75] Inventor: George E. Whipps, Athol, Mass.

[73] Assignee: Whipps, Inc., Athol, Mass.

[21] Appl. No.: 131,914

[22] Filed: Dec. 11, 1987

[51] Int. Cl.[4] ..... E02B 7/28; E02B 7/54

[52] U.S. Cl. ..... 405/106; 405/104

[58] Field of Search ..... 405/103, 104, 105, 106; 251/326, 328

[56] References Cited

U.S. PATENT DOCUMENTS

| | | | |
|---|---|---|---|
| 2,889,684 | 6/1959 | Abrahams | 405/106 |
| 4,226,553 | 10/1980 | Whipps et al. | 403/106 |
| 4,524,950 | 6/1985 | Vitas et al. | 405/106 X |
| 4,700,927 | 10/1987 | Henderson | 251/158 |
| 4,726,709 | 2/1988 | Labelle | 405/103 |

*Primary Examiner*—David H. Corbin

*Attorney, Agent, or Firm*—Schiller, Pandiscio & Kusmer

[57] ABSTRACT

A slide gate has a frame assembly with a pair of side guides, a bottom member and a top member that define an opening through which fluid flows. A movable slide plate is mounted to the frame assembly and constrained for movement between unblocking and blocking positions for regulating fluid flow through the opening. A side seal, which is seated within each side guide of the frame assembly, has a lip seal portion and bulbous portion, the side margins of the slide plate being received in sealing engagement between the lip seal portion and the bulbous portion. A bottom seal, which is seated in the bottom member, has a flat sealing surface which is in sealing contact with the bottom of the slide plate when the gate is closed. An adjustable lip seal, which is seated in the top member, is in sealing contact with the slide plate.

20 Claims, 5 Drawing Sheets

SLIDE GATE AND SEALS THEREFOR

BACKGROUND OF THE INVENTION

1. Field of the Invention:

This invention relates to slide gates for controlling fluid flow and, more particularly, is directed toward an improved slide gate and slide gate seals.

2. Description of the Prior Art:

Slide gates are employed to control fluid flow through a passageway or channel. A slide gate has a frame assembly which defines an opening through which fluid flows, a slide plate slidably mounted to the frame assembly and adapted for vertical movement relative thereto so as to selectively open and close the opening, a sealing member for providing a watertight seal between the slide plate and frame assembly, and operating means for vertically moving the slide plate between open and closed positions for regulating fluid flow through the opening. Generally, the frame assembly is mounted to the walls surrounding or defining the passageway or channel through which the fluid flows in such a manner that substantially all of the fluid flow passes through the opening in the frame assembly. In this way, fluid flow through the opening of the slide gate is determined by the position of the slide plate within the frame assembly. Typical slide gates are shown in U.S. Pat. Nos. 3,760,593; 4,028,896; and 4,226,533.

Slide gates have been met with varying degrees of success due to a number of disadvantages and limitations associated with the seals which are used to provide a watertight connection between the slide plate and the frame assembly. The most common type of seal presently in use is the resilient bulb seal, generally known as the P-type or J-type seal. Bulb seals have a flat elongated body with an enlarged hollow or solid bulb at one end. The flat body of the seal is sated within the frame assembly and the enlarged bulb is compressed between the movable slide plate and the frame assembly. The compressed bulb fills the region between the slide plate and the frame assembly and provides a watertight seal, while allowing movement of the slide plate relative to the frame assembly. In other cases, the compressed bulb seal is positioned between the slide plate and the wall surrounding the passageway or channel through which the fluid flows.

In either case, due to frictional contact between the bulb and the slide plate, the compressed bulb has a tendency to bind with and restrict the movement of the slide plate. In consequence, heavier and stronger operating means are required to move the slide plate for opening and closing the slide gate. Also, the excessive frictional contact between the seal and slide plate results in high operating forces being required and in premature failure of the seal. Furthermore, the bulb portion of the seal tends to dam fluid (and any debris carried by the fluid) about the seal and impede fluid flow through the slide gate when the slide plate is in its unblocking or open position. Prior to the present invention, seal retainers required at the sides of the slide gate were costly to produce, laborious to install and repair, and unpredictable with respect to the amount of drag produced on the slide plate.

Alternative seal designs, which do not use a compressed bulb, have suffered from the disadvantages that they are not watertight seals. Also, these seals are short-lived, costly to manufacture and difficult to install. Slide gates which use stainless steel extruded frame members have met limited degrees of success. Stainless steel extrusions generally are not consistent in size and slide gates using such extrusions are characterized by poor sealing.

SUMMARY OF THE INVENTION

An object of the present invention is to provide a slide gate which does not suffer from the heretofore mentioned disadvantages and limitations.

Another object of the present invention is to provide slide gate seals which do not suffer from the heretofore mentioned disadvantages and limitations.

A further object of the present invention is to provide a slide gate having a substantially rectangular frame assembly which defines an opening through which fluid flow is directed, a slide plate mounted to the frame assembly and constrained for relative vertical movement so as to selectively open and close the opening in the frame assembly, operating means carried by the frame assembly for moving the slide plate relative to the frame assembly between open and closed or blocked and unblocked positions, and sealing members mounted to the frame assembly for providing a watertight seal between the slide plate and the frame assembly. The frame assembly is formed from a plurality of interconnected extruded members that are formed with a substantially U-shaped channel, and includes a sealing member seated within the U-shaped channels. A side seal is seated in each side member of the frame assembly. Each side seal has a pair of U-shaped channels defining a double U-shaped channel formed by a pair of sidewalls with a common wall between the sidewalls. The common wall has a bulbous upper portion. The interior surface of one U-shaped channel has a lip seal in the form of a pair of inwardly extending lips that face the bulbous portion of the common wall, the slide plate being received in sealing engagement between the lip seal and the bulbous portion. The exterior sidewalls of each side seal has a plurality of barbed ribs which accommodate irregularities in the channels formed in the extruded frame assembly. A lower seal is seated in the bottom of the frame assembly for sealing the lower end of the slide plate when the slide plate is in its closed position. In certain applications, a horizontally extending upper seal in the form of an adjustable lip seal provides sealing contact between a top frame member and the slide plate.

The invention accordingly comprises the devices and apparatuses, together with their parts, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
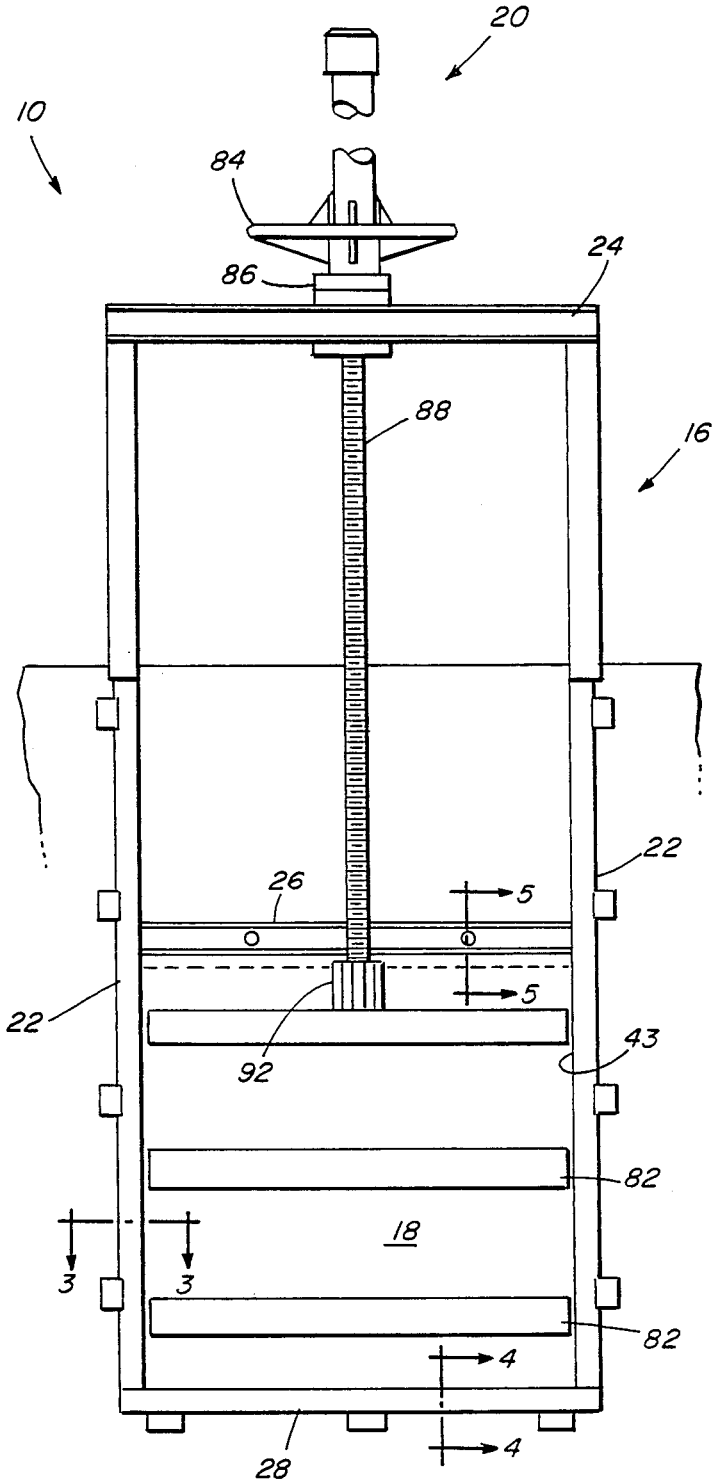
FIG. 1 is a front view of a bolt-on slide gate assembly embodying the present invention.
Figure 2:
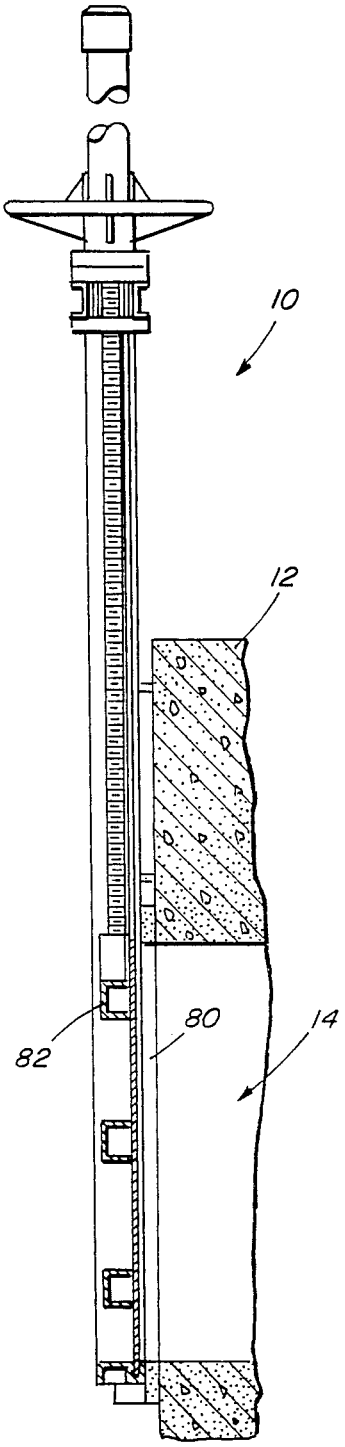
FIG. 2 is a side view of the slide gate assembly shown in FIG. 1.

Referring now to the drawings, particularly FIGS. 1 and 2, there is shown a slide gate assembly 10 constructed in accordance with the teachings of the present invention mounted on a cement wall 12 with anchor bolts and defining a waterway 14. Slide gate assembly 10 comprises a frame assembly 16, a gate slide plate 18 and a slide plate operator 20.

Frame assembly 16 includes a pair of side gate guides 22, a top yoke member 24, an upper horizontal member 26 and an invert bottom member 28. Each of the side gate guides 22 is provided with a flange 30 (FIG. 3) on its front side and a substantially U-shaped channel 32 having side members 34, 36 and a bottom member 38. In the preferred embodiment, each side gate guide 22 is an extruded member and is composed of stainless steel or similar material. A plurality of spaced angle brackets 39 are fastened to bottom member 38 for anchoring the side gate guides 22 to the cement wall 12 by means of anchoring bolts and nuts 41, for example. In the illustrated embodiment, by way of example, angle brackets 39 are welded to the bottom member 38. Preferably, a stratum of grout 114 is disposed between cement wall 12 and angle brackets 39 to provide a watertight connection. The open portion of channel 32 in one of the side gate guides 22 faces the open portion of channel 32 in the other slide gate guide 22. Top yoke member 24 is fixed to the tops of side gate guides 22 at right angles thereto. Top yoke member 24 is preferably welded to side gate guides 22, though other known means of rigid attachment may be used. Upper horizontal member 26, which is mounted to the side gate guides 22 at right angles thereto, preferably is welded to the side gate guides. The bottom ends of side gate guides 22 are spanned by the invert bottom member 28, which is set a right angles to the side gate guides and is welded thereto. Side gate guides 22, top yoke member 24, horizontal member 26 and invert bottom member 28 combine to form a structurally rigid frame assembly 16. Side gate guides 22, horizontal member 26 and invert member 28 form a substantially rectangular opening 43 through which fluid flow is directed.

Figure 3:
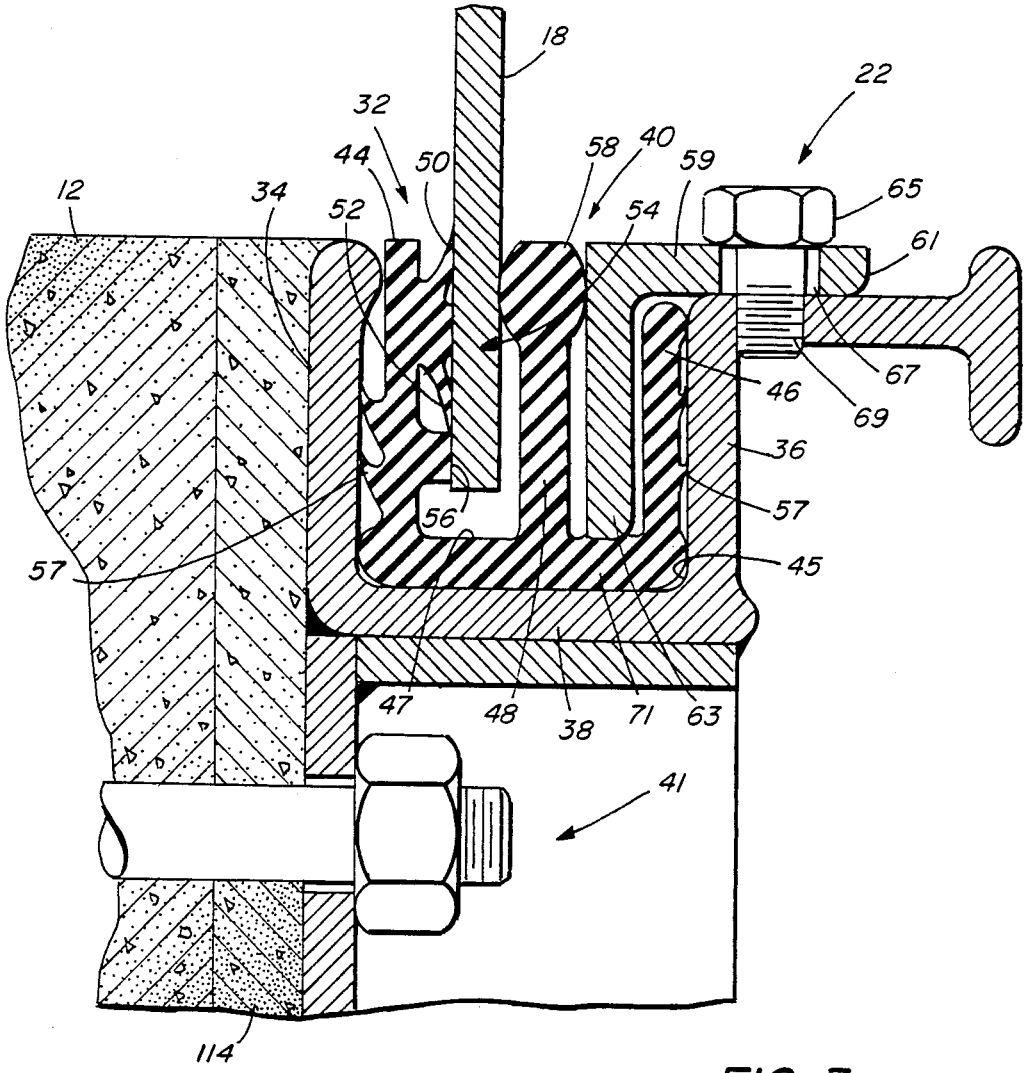
FIG. 3 is a sectional view taken along the line 3—3 in FIG. 1.

Referring now to FIG. 3, it will be seen that each of the side gate guides 22 is formed with a U-shaped channel 32 which runs for the full length of the frame assembly 16 or at least the full length of opening 43 and is oriented so that its open side faces inwardly. A resilient side seal 40 is seated within each U-shaped channel 32. Preferably, side seals 40 are extruded members and are composed of a copolymer of Hytrel and Kevlar. In an alternate embodiment, side seals 40 are composed of an elastomeric material having a relatively low coefficient of friction, e.g., ultra high molecular weight polyethylene (also known as UMHW). Each side seal 40 extends along the entire length of the side gate guide 22, between horizontal member 26 and invert bottom member 28.

Each side seal 40 has a pair of substantially U-shaped channels 45, 47 formed by sidewalls 44, 46 and a common wall 48 which is disposed between the sidewalls. The interior surface of sidewall 44 has a pair of extending lips 50, 52, which form a lip seal 54, and a pad 56. Common wall 48 is formed with a bulbous upper portion 58 at its end nearest the mouth of channel 32. Slide plate 18 is received in the U-shaped channel 47 which is formed between the sidewall 44 and the common wall 48; lip seal 54 and pad 56 bear against one face of the slide plate and bulbous portion 58 bears against the opposite face of the slide plate. If fluid pressure is highest on the unseating head side of slide plate 18, the fluid pressure causes lip 50 to press against the slide plate to form a tight seal. On the other hand, if fluid pressure is highest on the seating head side of slide plate 18, the fluid passing between bulbous portion 58 and the slide plate forces lip 52 to press against the slide plate, thereby preventing leakage between lips 50 and 52 of lip seal 54. That is, fluid pressure on the back sides of lips 50 and 52 assist in maintaining pressure at the sealing point. Pad 56 is provided to limit deflection of lip 52 due to fluid pressure from the seating head side. Lips 50 and 52 are resilient members which result in a low frictional force being exerted against slide plate 18 when the slide plate is moved vertically for controlling the size of opening 43 and regulating fluid flow. Preferably, each side seal 40 is formed with a plurality of barbed ribs 57 which accommodate any irregularities in the interior sidewalls of channel 32 in the extruded side gate guides 22. Side seals 40 are held to side gate guides 22 by an angled retainer 59 having legs 61 and 63. A screw 65, which passes through an elongated hole 67 in leg 61, is turned into a threaded hole 69 in flange 30. The end of leg 63 presses against a raised section 71 at the bottom of U-shaped channel 45. Elongated hole 67 permits adjustment in the position of leg 63 for controlling the force exerted by bulbous portion 58 on slide plate 18.

Figure 4:
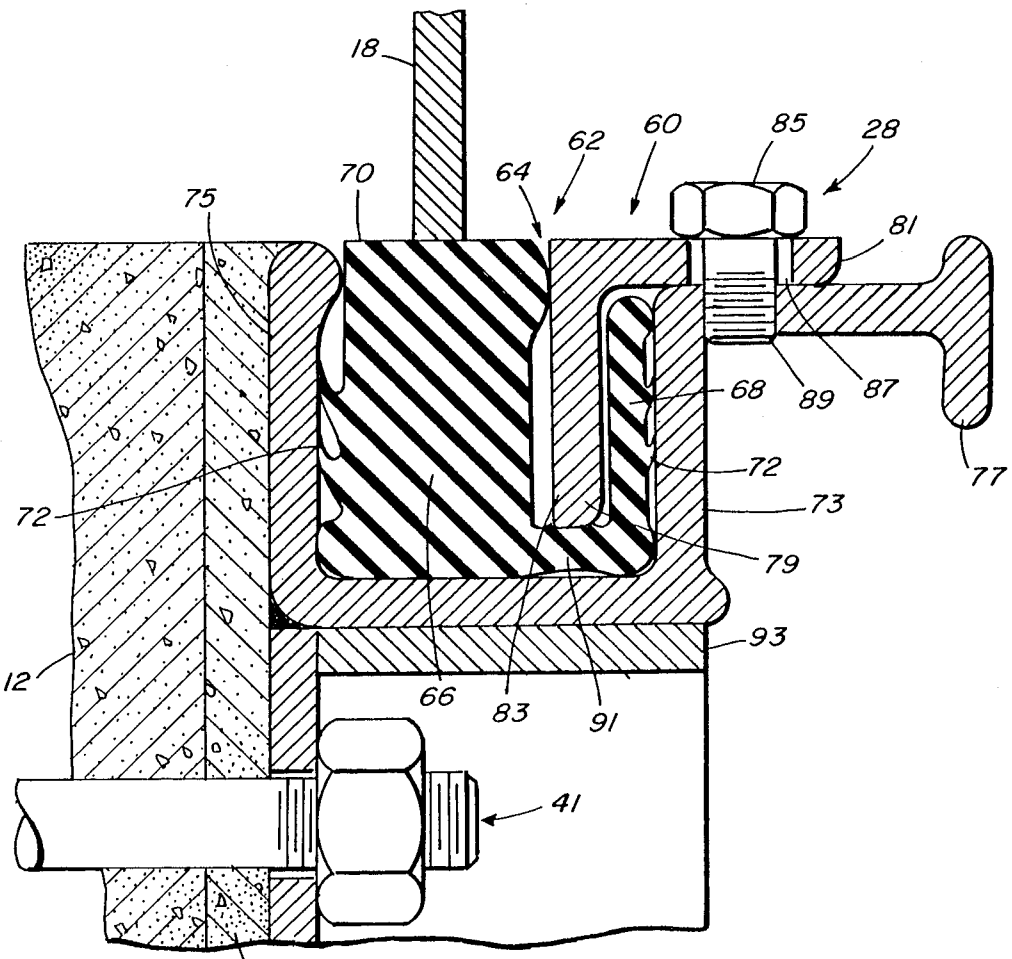
FIG. 4 is a sectional view taken along the line 4—4 in FIG. 1.

Referring now to FIG. 4, it will be seen that the invert bottom member 28 has the same cross-sectional shape as each of the side gate guides 22, the invert member having a U-shaped channel 60 formed between sidewalls 73, 75 and a flange 77. Preferably, invert member 28 is extruded from the same die as side gate guides 22 and is composed of stainless steel. A plurality of spaced angle brackets 93 are fastened to a bottom member 95 of invert member 28 for anchoring the invert member to the cement wall 12 by means of anchoring bolts and nuts 41. Preferably, a stratum of grout 114 is disposed between cement wall 12 and angle brackets 93 to provide a watertight connection. A resilient invert seal 62, preferably made of neoprene or some similar material, is seated in channel 60 and extends the entire length of the invert member 28. Seal 62 has a longitudinally extending, U-shaped channel 64 that is formed between a stop 66 and a wall 68. Stop 66 has a flat upper surface 70 which is in sealing engagement with the bottom edge of slide plate 18 when the slide gate 10 is in its closed or full blocking position. The lower ends of side seals 40 are in sealing contact with the invert seal 62 so as to provide a continuous seal between the side seals and the invert seal. The exterior surfaces of stop 66 and wall 68 are formed with a plurality of barbed ribs 72 that accommodate any irregularities in the extruded sidewalls of channel 60 of invert member 28. Invert seal 62 is held to invert member 28 by an angled retainer 79 having legs 81 and 83. A screw 85, which passes through an elongated hole 87 in leg 81, is turned into a threaded hole 89 in flange 77. The end of leg 83 presses against a raised section 91 at the bottom of U-shaped channel 60.

Figure 5:
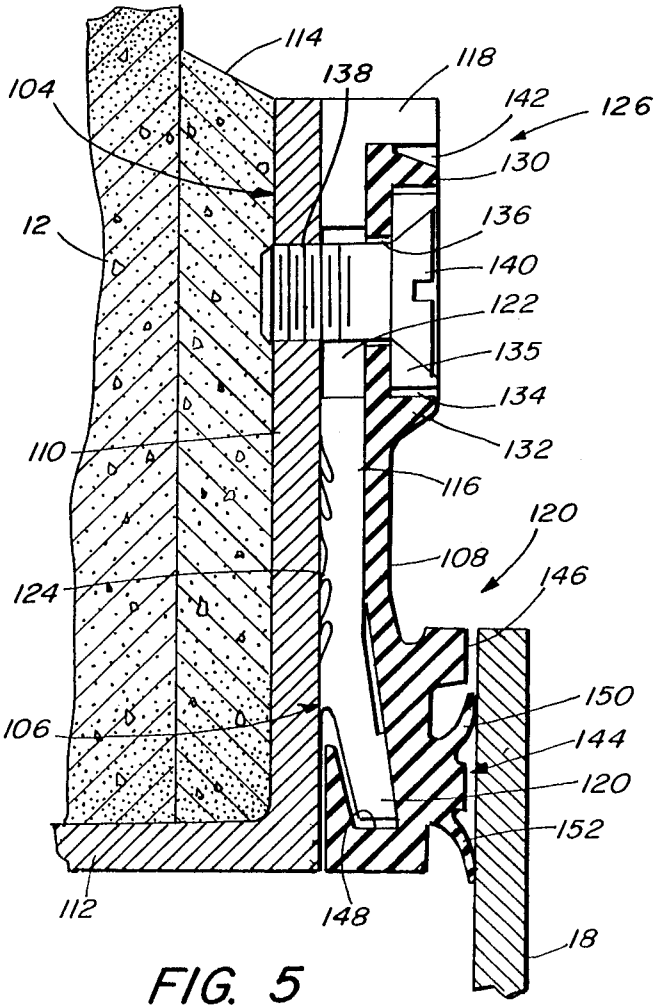
FIG. 5 is a sectional view taken along the line 5—5 in FIG. 1.

Referring now to FIG. 5, there is shown a cross section of horizontal member 26 which is mounted about the top of waterway 14 in concrete wall 12, for example, a dam or a side wall in a concrete basin, holding tank or lagoon. The interior opening defined by frame assembly 16, that is, side guides 22, horizontal member 26 and invert member 28, is sized so as to completely surround the opening 43 through which fluid flows. Horizontal member 26 includes a bracket 104, a wedge-shaped member 106 and a sealing member 108. Bracket 104 has a side flange 110 and a bottom flange 112. Bracket 104 is fastened to side gate guides 22 by welding, for example. A layer of grout 114 is disposed between bracket 104 and concrete wall 12, in the manner shown in FIG. 5, whereby the bracket forms a rigid watertight extension of the concrete wall 12 about the discharge opening 43.

Wedge-shaped member 106 has an elongated body 116 with an upper lip 118 and a lower tongue 120 that defines a substantially L-shaped structure. An elongated through hole 122 is formed in the upper portion of body 116 and a plurality of ribs 124 extend outwardly from the rear of body 116 in contact with flange 110. Tongue 120 projects outwardly from flange 110.

Sealing member 108 has an upper mounting portion 126 and an adjustable lower sealing portion 128. Upper mounting portion 126 has a pair of ribs 130, 132 that bound a recess 134 which is configured to receive a retainer 135. A screw 140, which passes through a hole in retainer 135, a hole 136 in mounting portion 126 and hole 122, is turned into a threaded hole 138 in flange 110. A slot 142, which is formed between lip 118 and rib 130, is configured to receive an alignment tool (not shown), for example a screw driver blade, for moving sealing member 108 relative to wedge-shaped member 106 for adjusting lower sealing portion 128.

Adjustable lower sealing portion 128 includes a lip seal 144 and a bearing pad 146 at the forward face of sealing member 108 and a U-shaped cavity 148 at the rear of the sealing member. Lip seal 144 has a pair of extending lips 150 and 152 which seal against slide plate 18. U-shaped cavity 148 is configured to receive tongue 120. When wedge-shaped member 106 is urged upwardly by the alignment tool, tongue 102 moves upwardly and forces lip seal 144 outwardly into greater sealing contact with slide plate 18 to compensate for any unevenness in the face of the slide plate.

It is to be noted that, in the illustrated embodiment, the cross-sectional profile of each lip seal 54 is similar to the cross-sectional profile of lip seal 144. Lip seals 54 are in butting relationship with lip seal 144 to provide a continuous seal between side gate guides 22 and horizontal member 26. In one example, lip seals 54 and lip seal 144 are joined at a mitered corner.

As previously indicated the slide plate 18 is mounted for slidable, vertical movement within frame assembly 16. Slide plate 18 includes a flat metal plate 80 (FIG. 2) whose opposite side margins are slidably received between lip seal 54 and bulbous portion 56 as shown in FIG. 3 when slide plate 18 is in its lowest or blocking position within the frame assembly 16, the slide plate is in sealing engagement with the top flat surface 70 of resilient stop 66 (FIG. 4). A plurality of stiffener elements 82 are preferably welded to the front side of plate 80 so as to give the slide plate 18 greater structural integrity. Stiffeners 82 are sized so that they will not contact side gate guides 22 as slide plate 18 moves vertically within the frame assembly 16.

As shown in FIG. 1, the slide plate operator 20, which moves slide plate 18 vertically relative to frame assembly 16, includes a handwheel 84 that is connected to a nut (not shown) which is journalled for rotation in a housing 86. Housing 86 is mounted to top yoke member 24. A threaded spindle or stem 88 extends through the nut in housing 86 and up through the handwheel 84. Spindle 88 is secured at its lower end to the slide plate 18 by means of a connector 92. Connector 92 is mounted to slide plate 18 and the uppermost stiffener element 82 by welding or other suitable means of attachment. Thus, by turning handwheel 84 in one direction, the slide plate 18 is raised upwards within the frame assembly 16 toward the open or unblocking position of slide gate 10. By turning the handwheel in the opposite direction, the slide plate 18 is lowered within the frame assembly to any selected height or until the bottom of the slide plate engages the flat surface 70 of stop 66 and the slide gate is in its closed or full blocking position.

Figure 6:
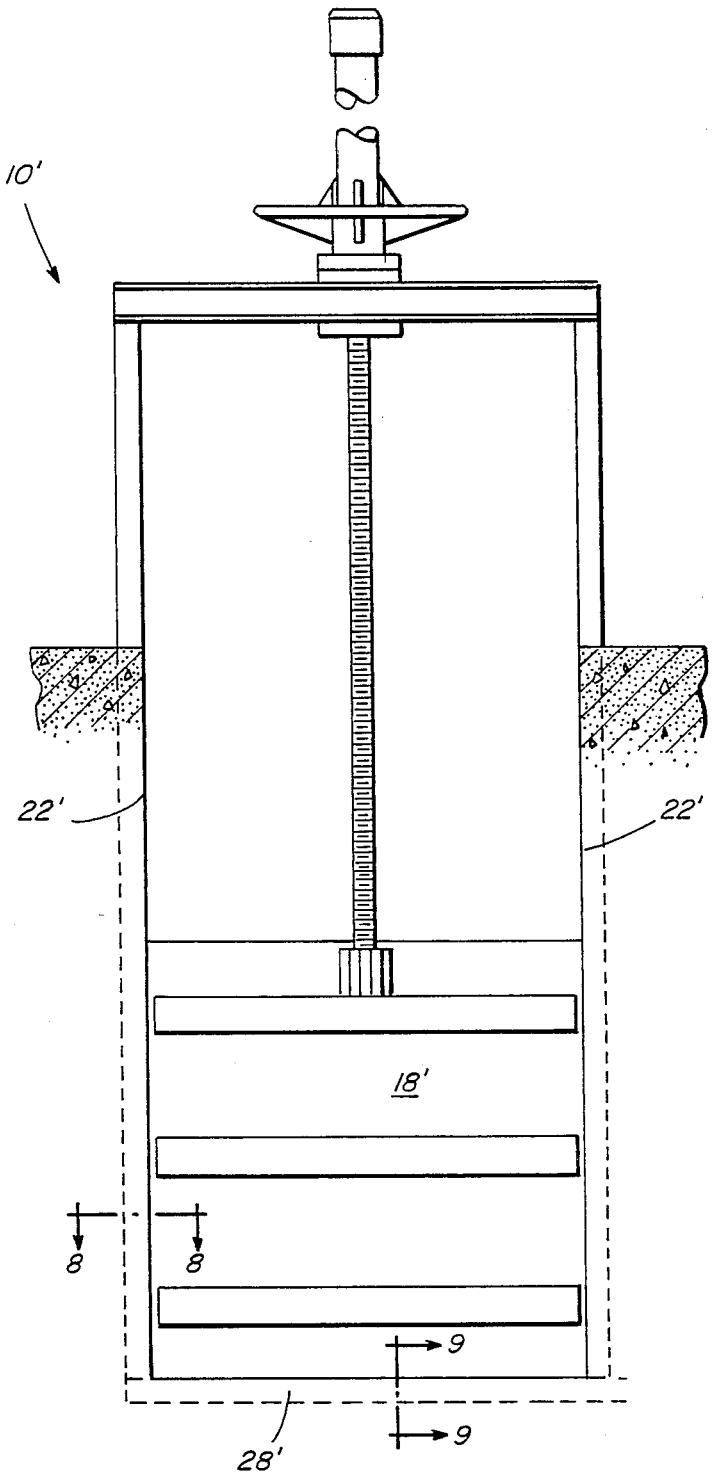
FIG. 6 is a front view of an embedded slide gate assembly embodying the present invention.
Figure 7:
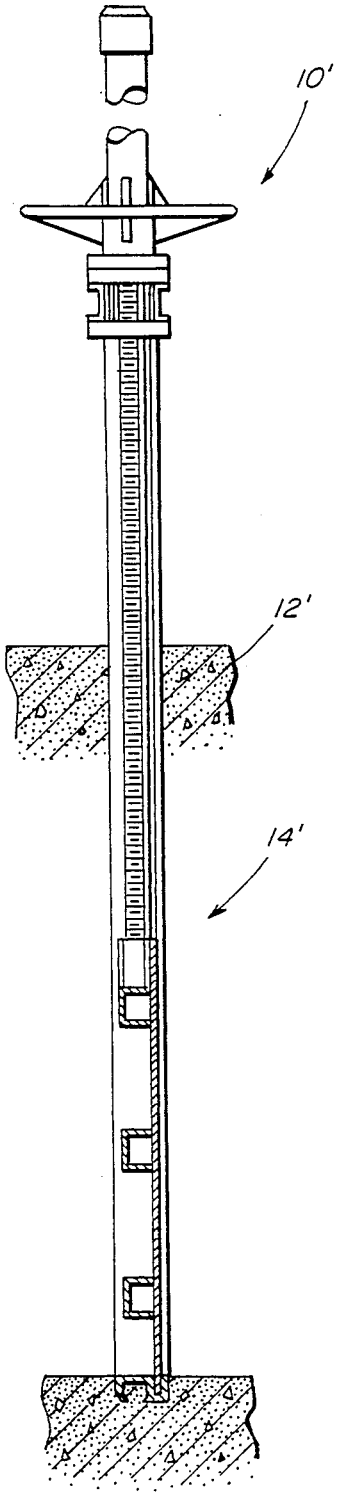
FIG. 7 is a side view of FIG. 6.
Figure 8:
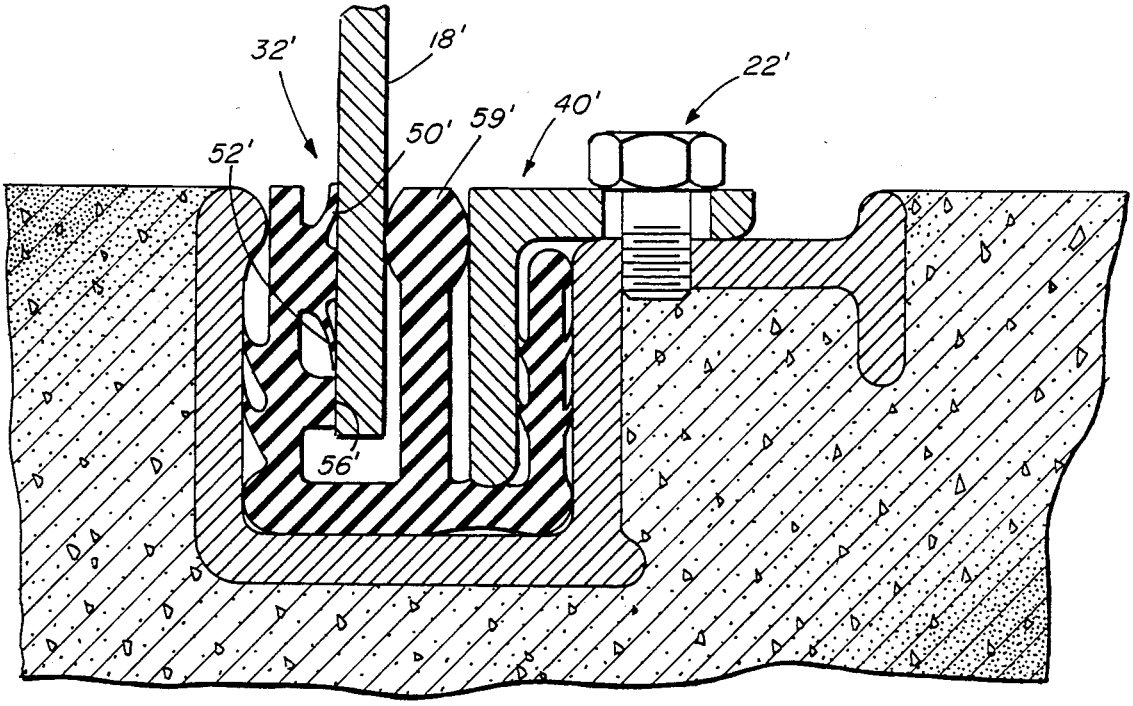
FIG. 8 is a sectional view taken along the line 8—8 in FIG. 7.
Figure 9:
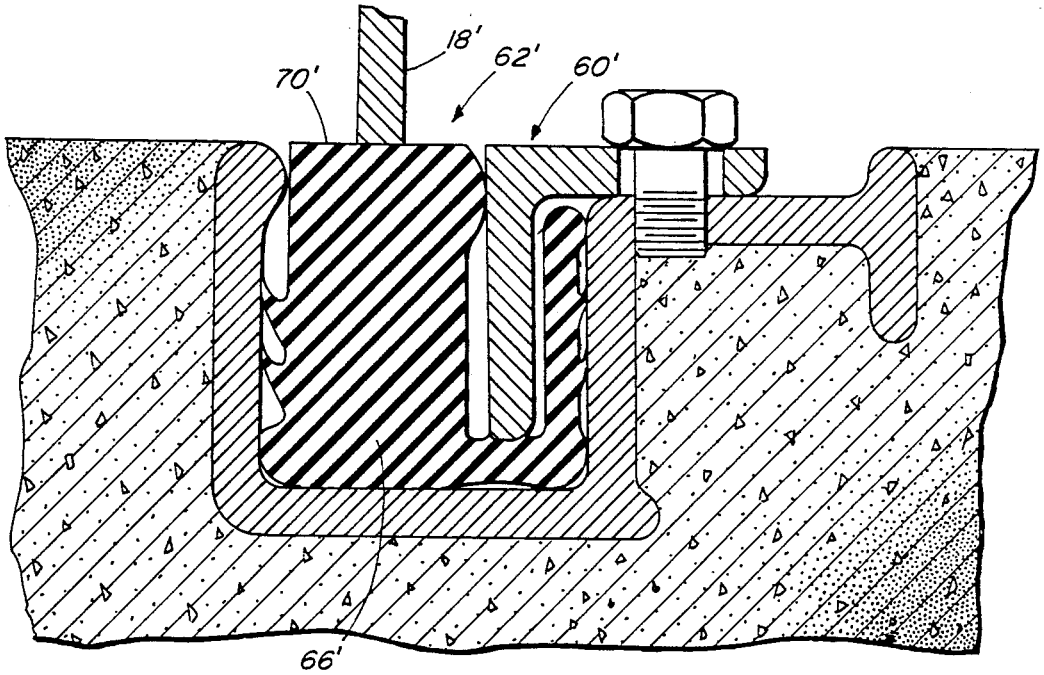
FIG. 9 is a sectional view taken along line 9—9 in FIG. 7.

Referring now to FIGS. 6–9, there is shown an alternative embodiment of bolt-on slide gate 10 in the form of an embedded slide gate 10'. Slide gate 10' is similar in construction to slide gate 10 an corresponding elements are distinguished by a primed notation. Generally, side gate guides 22' and invert bottom member 28' are embedded in concrete as shown in FIGS. 6 and 7. In this case, the water level in a waterway 14' is well below the top of the cement wall 12'. Accordingly, there is no need for an upper horizontal member which corresponds to horizontal member 26. The operation of slide gate 10' is similar to that of slide gate 10. Slide plate 18' is vertically slidable within side gate guides 22' and controls fluid flow in the manner previously described in connection with FIGS. 1–5.

Since certain changes may be made in the foregoing disclosure without departing from the scope of the invention herein involved, it is intended that all matter contained in the above description and depicted in the accompanying drawings be construed in an illustrative and not in a limited manner.

What is claimed is:

1. A slide gate mechanism for controlling fluid flow through an opening in a wall, said slide gate mechanism comprising:

(a) a frame assembly having first and second gate guide members for disposition along the sides of said opening and at least a third gate guide member extending between said first and second gate guide members for disposition along the bottom of said opening, said third gate guide member interconnecting said first and second gate guide members;

(b) a slide plate locked between said first and second gate guide members and constrained for limited movement relative to said first and second gate guide members;

(c) operating means carried by said frame assembly and connected to said slide plate, said operating means being operable to selectively move said slide plate in one direction or an opposite direction relative to said first, second and third gate guide members so that said slide plate may be disposed in blocking or unblocking relation with said opening;

(d) first seal means associated with said first and second gate guide members, each of said first seal means including first lip seal means and resilient seal means, said first lip seal means engaging and pressing against the margin of one face of said slide plate, said resilient seal means engaging and pressing against the margin of an opposite face of said slide plate, the margins of said slide plate being received between said lip seal means and said resilient seal means;

(e) first adjustable retainer means received in each said first and second gate guide members, said first adjustable retainer means configured to be moved within each said first and second gate guide member for controlling the force exerted by said first seal means and said resilient seal means on said faces of said slide plate; and (f) second seal means seated in said third gate guide member for engaging the bottom of said slide plate when said slide plate is in its full blocking position, said second seal means in sealing relationship with said first seal means.

2. A slide gate as claimed in claim 1, wherein said first seal means has a pair of said members and a common wall between said side members, said side members and said common wall forming first and second U-shaped channels.

3. A slide gate as claimed in claim 2, wherein first U-shaped channel is configured to receive said slide plate, said first U-shaped channel bounded on its sides by one of said side members and said common wall, said one side member has a pair of extending lips defining said first lip seal means, said resilient means formed on said common wall, said slide plate received between said extending lips and said resilient means.

4. A slide gate as claimed in claim 3 wherein said first adjustable retainer means has an extending arm which is received within said second U-shaped channel of said first sealing means for holding said first sealing means in said first and second ate guide members, said arm configured to bear against said resilient means for controlling the force exerted by said first lip seal means and said resilient means on said slide plate.

5. A slide gate as claimed in claim 1 including:

(a) a fourth gate guide member extending between said first and second gate guide members for disposition along the top of said opening, said fourth gate guide member interconnecting said first and second gate guide members; and (b) third sealing means seated in said fourth gate guide member, said third sealing means in sealing contact with said slide plate, said third sealing means in sealing relationship with said first seal means.

6. A slide gate as claimed in claim 5 wherein said third seal means includes second lip seal means, said second lip seal means in sealing contact with said one face of said slide plate.

7. A slide plate as claimed in claim 6 wherein said third seal means includes slidable wedge shaped adjustment means in contact with said second lip seal means for controlling the contact force between said second lip seal means and said one face of said slide plate.

8. A slide gate as claimed in claim 6 wherein said first lip seal means and said second lip seal means have similar cross sections, said first lip seal means in butting relationship with said second lip seal means.

9. A slide gate as claimed in claim 1 wherein said first and second gate guide members are extruded members and wherein said first sealing means includes a plurality of barb means extending from an exterior surface thereof, said barb means in contact with the interior sidewalls cf said first and second gate guide members.

10. A slide gate as claimed in claim 1 wherein said second seal means is formed with substantially longitudinally extending, U-shaped channel which is bounded by a pair of sidewalls, the upper surface of one of sidewall being in sealing contact with the bottom of said slide plate when said slide plate is in its full blocking position.

11. A slide wall gate for controlling fluid flow through an opening in a wall, said slide gate comprising:

(a) a frame assembly having first and second gate guide members for disposition along the sides of said opening, a third gate guide member extending between said first and second members for disposition along the bottom of said opening, and a fourth gate guide member extending between said first and second members for disposition along the top of said opening, said first gate guide interconnecting said first and second gate guide members, and said fourth gate guide interconnecting said first and second gate guide members;

(b) a slide plate located between said first and second gate guide members and constrained for limited movement relative to said first, second, third and fourth gate guide members;

(c) operating means carried by said frame assembly and connected to said slide plate, said operating means operable to selectively move said slide plate in one direction or an opposite direction relative to said first, second, third and fourth gate guide members so that said slide plate may be disposed in blocking or unblocking relation with said opening;

(d) first seal means seated in said first gate guide member, said first seal means including first lip seal means and first bulb means, said first lip seal means engaging and pressing against the margin of one face of said slide plate, said first bulb means for engaging and pressing against the margin of an opposite face of said slide plate, the margins of said slide plate being received between said first lip seal means and said first bulb means;

(e) second seal means seated in said second gate guide member, said second seal means including second lip seal means and second bulb means, said second lip seal means engaging and pressing against the margins of said one face of said slide plate and said second bulb means engaging and pressing against the margin of said opposite face of said slide plate, the margins of said slide plate being received between said second lip seal means and said second bulb means;

(f) third seal means seated in said third gate guide member for engaging the bottom of said slide plate when said slide plate is in its full blocking position, said third seal means in sealing relationship with said first and second seal means;

(g) fourth seal means seated in said fourth gate guide member for sealingly engaging said slide plate, said fourth seal means in sealing relationship with said first and second seal means;

(h) first adjustable retainer means adjustably mounted to said first gate guide member and received in said first seal means, said first adjustable retainer means configured to retain said first seal means in said first gate guide member and to bear against said first seal means for controlling the force exerted by said first lip seal means and said first bulb means against said slide plate; and (i) second adjustable retainer means adjustably mounted to said second gate guide member and received in said second seal means, said second adjustable retainer means configured to retain said second seal means in said second gate guide member and to bear against said second seal means for controlling the force exerted by said second lip seal means and said second bulb means against said slide plate.

12. A slide gate as claimed in claim 11 wherein said first seal means has a pair of sidewalls and a common wall between said sidewalls, said sidewalls and said common wall of said first seal means forming first and second U-shaped channels, said common wall of said first seal means separating said first and second U-shaped channels; and further wherein said second seal means has a pair of sidewalls and a common wall between said sidewalls, said sidewalls and said common wall of said second seal means forming third and fourth U-shaped channels, and said common wall of said second seal means separating said third and fourth U-shaped channels.

13. A slide gate as claimed in claim 12 wherein said first U-shaped channel is configured to receive said slide plate and said second U-shaped channel is configured to receive said first adjustable retainer means, said first U-shaped channel is bounded on its sides by one of said sidewalls and said common wall of said first seal means, said one sidewall of said first seal means has a pair of extending first lips defining said first lip seal means, said common wall of said first seal means has said first bulb means at the mouth of said first U-shaped channel, the margin of said slide plate being received between said extending first lips and said first bulb means, and wherein said third U-shaped channel is configured to receive said slide plate and said fourth U-shaped channel is configured to receive said second adjustable retainer means, said third U-shaped channel being bounded on its sides by one of said sidewalls and said common wall of said second seal means, said one sidewalls of said second seal means having a pair of extending second lips defining said second lip seal means, said common wall of said second seal means having said second bulb means at the mouth of said third U-shaped channel, and the margin of said slide plate being received between said extending second lips and said second bulb means.

14. A slide gate as claimed in claim 13 wherein said third seal means is formed with a substantially longitudinally extending, U-shaped channel which is bounded by a pair of sidewalls, and the upper surface of one sidewall of said third seal means is in sealing contact with the bottom of said slide plate when said plate is in its full blocking position.

15. A slide gate as claimed in claim 14 wherein said fourth seal means includes third lip seal means, said third lip seal means being in sealing contact with said one face of said slide plate.

16. A slide gate as claimed in claim 15 wherein said fourth seal means includes adjustment means in contact with said third lip seal means for controlling the contact force between said third lip seal means and said one face of said slide plate.

17. A slide gate as claimed in claim 16 wherein said first lip seal means, said second lip seal means and said third lip seal means have similar cross sections, and said first and second lip seal means are in butting relationship with said third lip seal means so as to form a continuous seal between said first, second and fourth seal means.

18. A slide gate as claimed in claim 17 wherein said first, second, and third gate guide members are extruded members having like cross sectional profiles and wherein each of said first, second and third seal means includes a plurality of barb means extending from an exterior surface thereof, said barb means being in sealing contact with the interior sidewalls of said first, second and third gate guide members, and said barb means compensating for irregularities in the sidewalls of said first, second and third gate guide members.

19. A slide gate for controlling fluid flow through an opening in a wall, said slide gate comprising:

(a) a frame assembly having first and second gate guide members for disposition along the sides of said opening, and a third gate guide member extending between said first and second members for disposition along the bottom of said opening, said third gate guide member interconnecting said first and second gate guide members;

(b) a slide plate located between said first and second gate guide members and constrained for limited movement relative to said first, second and third gate guide members;

(c) operating means carried by said frame assembly and connected to said slide plate, said operating means being operable to selectively move said slide plate in one direction or an opposite direction relative to said first, second and third gate guide members so that said slide plate may be disposed in blocking or unblocking relation with said opening;

(d) first seal means seated in said first gate guide member, said first seal means including first lip seal means for engaging the margin of one face of said slide plate at one side thereof and first bulb means for engaging the margin of an opposite face of said slide plate at said one side, the margins of said slide plate at said one side being received between said first lip seal means and said first bulb means;

(e) second seal means seated in said second gate guide member, said second seal means including second lip seal means for engaging the margin of said one face of said slide plate at the other side of said slide plate and second bulb means for engaging the margins of said opposite face of said slide plate at said other side, the margins of said slide plate at said other side being received between said second lip seal means and said second bulb means;

(f) third seal means seated in said third gate guide member for engaging the bottom of said slide plate when said slide plate is in its full blocking position, said third seal means being in sealing relationship with said first and second seal means;

(g) first adjustable retainer means and adjustably mounted to said first gate guide member and received in said first seal means, said first adjustable retainer means configured to retain said first seal means in said first gate guide member and to bear against said first seal means for controlling the force exerted by said first lip seal means and said first bulb means against said slide plate; and (h) second adjustable retainer means adjustably mounted to said second gate guide member and received in said second seal means, said second adjustable retainer means configured to retain said second seal means in said second gate guide member and to bear against said second seal means for controlling the force exerted by said second lip seal means and said second bulb means against said slide plate.

20. A slide gate as claimed in claim 19 including:

(a) a fourth gate guide member extending between said first and second gate guide members for disposition along the top of said opening, said fourth gate guide member interconnecting said first and second gate guide members; and (b) fourth sealing means seated in said fourth gate guide, said fourth sealing means including third lip seal means in sealing contact with said slide plate, said third sealing means in sealing relationship with said first and second seal means.

* * * * *